US005216989A

United States Patent [19]

Iwata et al.

[11] Patent Number: 5,216,989

[45] Date of Patent: Jun. 8, 1993

[54] APPARATUS FOR DRIVING VARIOUS DEVICES BY INTERNAL COMBUSTION ENGINE

[75] Inventors: Noriyuki Iwata, Hiroshima; Toshimitsu Tanaka, Otake; Naoyuki Yamagata, Hiroshima; Tatsuya Uesugi, Higashihiroshima, all of Japan

[73] Assignee: Mazda Motor Corporation, Hiroshima, Japan

[21] Appl. No.: 800,355

[22] Filed: Dec. 2, 1991

[30] Foreign Application Priority Data

Nov. 30, 1990 [JP] Japan ..... 2-340088
Nov. 30, 1990 [JP] Japan ..... 2-340089

[51] Int. Cl.[5] ..... F01L 1/02
[52] U.S. Cl. ..... 123/90.31; 123/198 R
[58] Field of Search ..... 123/90.31, 198 R, 90.17

[56] References Cited

U.S. PATENT DOCUMENTS

| | | | |
|---|---|---|---|
| 3,730,147 | 5/1973 | Buchwald | 123/198 R |
| 4,643,143 | 2/1987 | Uchiyama et al. | 123/90.31 |
| 4,716,864 | 1/1988 | Binder | 123/90.31 |
| 4,841,789 | 6/1989 | Ochiai | 123/90.31 |
| 5,085,199 | 2/1992 | Sado et al. | 123/198 R |
| 5,129,375 | 7/1992 | Takane et al. | 123/90.31 |

FOREIGN PATENT DOCUMENTS

| | | | |
|---|---|---|---|
| 62-71340 | 5/1987 | Japan . | |
| 285228 | 11/1988 | Japan | 123/90.17 |
| 262327 | 10/1989 | Japan | 123/198 R |
| 201006 | 8/1990 | Japan | 123/90.31 |
| 259204 | 10/1990 | Japan | 123/90.31 |
| 286832 | 11/1990 | Japan | 123/198 R |

*Primary Examiner*—E. Rollins Cross
*Assistant Examiner*—Weilun Lo
*Attorney, Agent, or Firm*—Keck, Mahin & Cate

[57] ABSTRACT

An apparatus for driving devices which are operated by, or "supplementary" to, a V-type internal combustion engine, having a crankshaft and overhead camshafts, includes a camshaft drive mechanism for rotatably connecting the camshafts to the crankshaft so that the camshafts are "timely" driven. A supplementary device drive mechanism rotatably connects supplementary devices independently of the overhead camshafts to the crankshaft. The crankshaft is provided with a transmission gear train for transmitting rotation of the camshafts to the camshaft drive mechanism and the supplementary device drive mechanism.

14 Claims, 2 Drawing Sheets

5216989

APPARATUS FOR DRIVING VARIOUS DEVICES BY INTERNAL COMBUSTION ENGINE

BACKGROUND OF THE INVENTION

The present invention relates to an apparatus for driving devices which are "supplementary" to, i.e., operated by, an internal combustion engine.

In the internal combustion engine art, for many years, attempts have been made to provide compact internal combustion engines having one or more of a variety of supplementary devices, such as an air compressor, an alternator, and an oil pump, and additional devices, such as a water pump and a supercharger. All of these devices are conventionally driven by an engine crankshaft. One such internal combustion engine is known from, for instance, Japanese Unexamined Utility Model Publication no. 62-71,340.

In attempts to provide a compact engine which has a short length and is equipped with supplementary devices driven by an engine crankshaft, various "V-type" internal combustion engines have recently been developed. In such an engine, an engine camshaft can be rotatably connected to overhead camshafts and any supplementary devices by both a camshaft timing belt and a supplementary device drive belt, respectively. In order to arrange the belts so that they do not interfere with each other, the belts must be placed in different spatial planes located at different distances from an end surface of the engine However, locating the belts in such planes causes the engine to have a large overall length and adversely affects the ability to make the engine compact in size In particular, in an engine equipped with a supercharger in addition to various other supplementary devices, the supercharger must be rotatably connected to the crankshaft by yet another belt. Because this other belt must be arranged so that it does not interfere with belts operating the overhead camshafts and the supplementary devices, the engine is made even larger in overall length if it includes a supercharger. In addition, if all of the belts are driven by the crankshaft, vibrations of the crankshaft, caused by a piston reaction, are transmitted to the camshafts. Such vibrations also can exert excess tension on the belts operating the supplementary devices and the supercharger. This adversely affects the durabilities of the belts.

SUMMARY OF THE INVENTION

It is, accordingly, a primary object of the present invention to provide an apparatus for driving supplementary devices off of a V-type internal combustion engine equipped with a variety of such supplementary devices which permits the engine to be made compact and small in overall length.

It is another object of the present invention to provide an apparatus for driving a supercharger and supplementary devices off of a V-type internal combustion engine, equipped with a variety of such supplementary devices, which improves the durability of belts used to drive the supplementary devices and the supercharger.

These objects, and others, are accomplished by providing an apparatus for driving supplementary devices of a V-type internal combustion engine which includes two cylinder banks disposed in a "V" formation and at an angle relative to each other. The engine has a crankshaft, extending from one end of an engine block, and overhead camshafts disposed over a cylinder head of each cylinder bank. The camshafts are rotatably connected to the crankshaft by camshaft drive means so as to be "timely" driven, i.e., driven such that valves, driven by the camshafts, are opened and closed at predetermined relative timings. The supplementary devices are rotatably connected to the crankshaft by supplementary device drive means for driving the supplementary devices. The crankshaft is provided with transmission means, for transmitting the rotation of the crankshaft independently of the camshaft drive means, and supplementary device drive means.

According to a preferred embodiment of the present invention, the camshaft drive means includes a camshaft pulley attached to each camshaft and a timing belt for rotatably connecting together all of the camshaft pulleys. The supplementary device drive means includes a supplementary device pulley attached to each supplementary device and a drive belt rotatably connecting all of the supplementary device pulleys. The timing belt and drive belt are disposed in the same plane and perpendicular to the crankshaft.

The transmission means has a balancer shaft incorporated in the engine. Either a first drive pulley, rotatably connected to the camshaft drive pulleys by the timing belt and rotatably connected to the crankshaft by a gear train, or a second drive pulley, rotatably connected to the supplementary device drive pulleys by the drive belt and rotatably connected to the crankshaft by a gear train, is connected to the balancer shaft.

BRIEF DESCRIPTION OF THE DRAWINGS

The above and other objects and features of the present invention will be apparent to those skilled in the art from the following description of preferred embodiments when considered in conjunction with the accompanying drawings. The same reference numerals have been used to designate the same or similar elements. In the drawings.

DETAILED DESCRIPTION OF THE PREFERRED EMBODIMENTS

Figure 1:
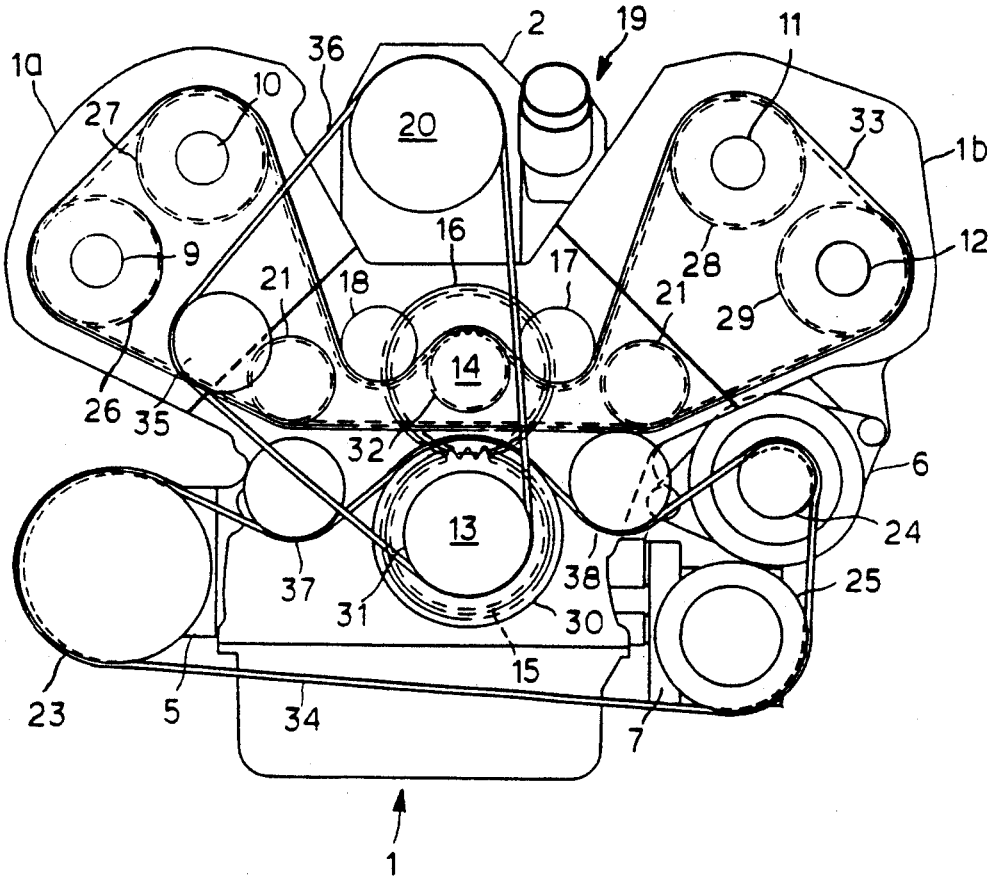
FIG. 1 is a front view of an apparatus for driving supplementary devices of a V-type internal combustion engine equipped with various supplementary devices according to a preferred embodiment of the present invention.
Figure 2:
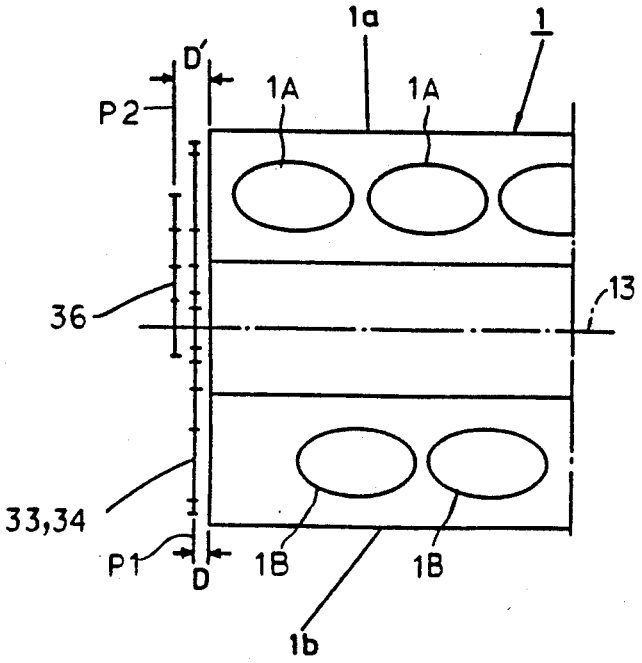
FIG. 2 is a diagrammatical view of the apparatus for driving supplementary devices of a V-type internal combustion engine equipped with various supplementary devices shown in FIG. 1.

Referring to the drawings in detail and, in particular, to FIGS. 1 and 2, a V-type overhead camshaft engine 1, having a plurality of (e.q., six) cylinders 1A and 1B is shown as being equipped with a supplementary device drive apparatus in accordance with a preferred embodiment of the present invention. As shown, the engine includes two cylinder banks 1*a* and 1*b* which are in a V-formation and disposed at an appropriate angle of, for instance, 90 degrees relative to each other. The cylinder banks form therebetween a V-shaped space 19. The row of cylinders 1A of the cylinder bank 1*a* is offset, in a lengthwise direction with respect to the engine body 1, relative to the row of cylinders 1B of the cylinder bank 1*b*. For example, in this embodiment, the cylinder bank 1*b* is offset rearward or backward (to the right, viewing FIG. 2) with respect to a vehicle body relative to the cylinder bank 1*a*.

The engine 1 has intake and exhaust camshafts 9 and 10, having pulleys 26 and 27, respectively, disposed over the cylinder bank 1*a*, and intake and exhaust camshafts 11 and 12, having pulleys 28 and 29, respectively, disposed over the cylinder bank 1*b*. The engine 1 further has a balancer shaft 14 which is disposed, parallel to a crankshaft 13, in an upper portion of the engine 1 below the V-shaped space 19. The balancer shaft is rotatably connected to counter gears 15 and 16 in mesh with each other and secured to front ends of the crankshaft 13 and the balancer shaft 14, respectively. The engine 1 is provided with a supercharger 2, having a pulley 20 located in the V-shaped space 19. The engine 1 also has two water pumps (not shown), each having a pulley 21, disposed adjacent to the front ends of the cylinder banks 1*a* and 1*b*. Locating the supercharger 2 in the V-shaped space 19 helps to efficiently use the V-shaped space 19 and permits the use of a somewhat oversized supercharger. The reason for providing one water pump for each cylinder bank is to deliver the same amount of water into the cylinder banks 1*a* and 1*b*. The pulleys 16 of the balancer shaft 14, the pulleys 26–29 of the camshafts 9–12 and the pulley 21 of the water pumps 3 are all placed in the same upper half area of a spatial plane Pl, perpendicular to the crankshaft 13, at a distance D from the front surface of the engine 1. The pulley 20 of the supercharger 2 is placed in another spatial plane P2, parallel to the plane P1, at a distance D', larger than the distance D, from the front end of the engine 1.

The engine 1 is further provided with various supplementary devices, such as an air compressor 5 for an air conditioning system (not shown), an alternator 6, and a power steering unit 7. The air compressor 5, having a pulley 23, is disposed on one side of the engine 1 below the cylinder head portion of the cylinder bank 1*a*. The alternator 6, having a pulley 24, is disposed on another side of the engine 1, remote from the side on which the air compressor 5 is disposed, just below the cylinder head portion of the cylinder bank 1*b*. The power steering unit 7 having a pulley 25 is disposed on the same side of the engine 1 as the alternator 6. The power steering unit 7 is also disposed below the alternator 6. Each of the pulleys 23–25 of the supplementary devices 5–7 is placed in a lower half area of the spatial plane P1.

The crankshaft 13 is provided, at its front end, with a small pulley 31 placed in the spatial plane P1 and a large pulley 30 placed in the spatial plane P2. The balancer shaft 14 is provided, at its front end, with a pulley 32 placed in the upper half area of the spatial plane P1.

The camshafts 9–12 and the water pumps are driven by a camshaft drive mechanism, including a timing belt 33. That is, the pulley 32 of the balancer shaft 14 is rotatably connected to the pulleys 26–29 of the respective camshafts 9–12 and the pulleys 21 of the water pumps. Again, all of these pulleys are placed in the upper half area of the spatial plane P1 at a distance D from the front end of the engine 1. The balancer shaft 14 is connected to the pulleys 26–29 by the timing belt 33 so as to drive the camshafts 9–12 and the water pumps. To apply a proper tension to the timing belt 33, an automatically adjustable tension roller 18 is disposed between the pulley 32 of the balancer shaft 14 and the pulley 27 of the exhaust camshaft 10 of the cylinder bank 1*a*. A tension roller 17 is also disposed between the pulleys 32 of the balancer shaft 14 and the pulley 28 of the intake camshaft 11 of the cylinder bank 1*b*. The supplementary devices 5–7 are driven by a supplementary device drive mechanism including a drive belt 34. The large pulley 30 of the crankshaft 13 is rotatably connected to the pulleys 23–25 of the air compressor 5, the alternator 6 and the power steering unit 7, respectively, all of which are placed in the lower half area of the spatial plane P1 at the distance D from the front end of the engine 1. More specifically, the large pulley 30 is connected to the pulleys 23–25 of the air compressor by the timing belt 34 so as to drive the air compressor 5, the alternator 6 and the power steering unit 7. To apply a proper tension to the drive belt 34, a tension roller 37 is disposed between the large pulley 30 of the crankshaft 13 and the pulley 23 of the air compressor 5. Also, an automatically adjustable tension roller 38 is disposed between the large pulley 30 of the crankshaft 13 and the pulley 24 of the alternator 6.

To drive the supercharger 2, the small pulley 31 of the crankshaft 13 and the pulley 20 of the supercharger 2, both of which are disposed in the spatial plane P2 at a distance D', larger than the distance D, from the front end of the engine 1, are rotatably connected to each other by a drive belt 36. Drive belt 36 is kept at an appropriate tension by a tension roller 35.

Because the mechanisms for the camshafts 9–12 and the supplementary devices 5–7 are placed in the upper and lower half areas of the same spatial plane P1, respectively, the engine 1 is made small in length, even if it includes these drive mechanisms and an additional supercharger drive mechanism. Accordingly, the portion of the crankshaft 13 projecting from the front end of the engine 1 may be kept short, so that the rigidity of the crankshaft 13 is increased and the resistance of the crankshaft 13 to transverse loads is improved. Furthermore, the crankshaft 13 is subjected to loads acting in opposite directions by the drive belts 34 and 36 for the supplementary devices and the supercharger 2. Because the portion of the crankshaft 13 projecting from the front of the engine is small, vibrations of the front end of the crankshaft 13, caused by piston reactions, are reduced.

In the apparatus for driving supplementary devices of a V-type internal combustion engine described above, the supercharger 2 may be driven by the balancer shaft 14 instead of the crankshaft 13.

Figure 3:
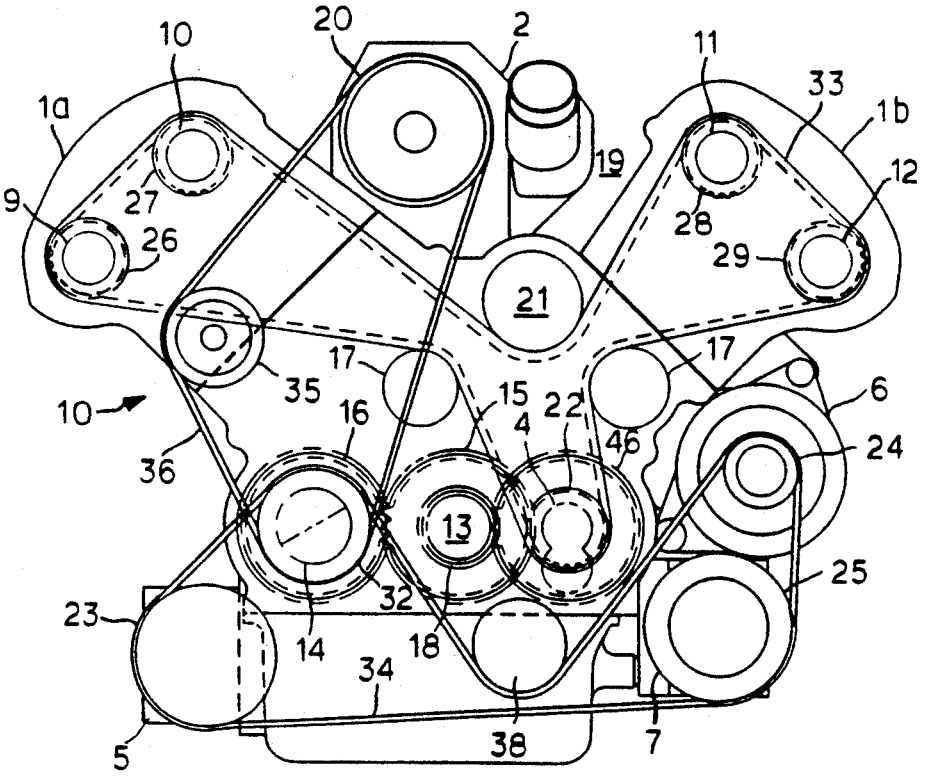
FIG. 3 is a front view of an apparatus for driving supplementary devices of a V-type internal combustion engine equipped with various supplementary devices according to another preferred embodiment of the present invention.
Figure 4:
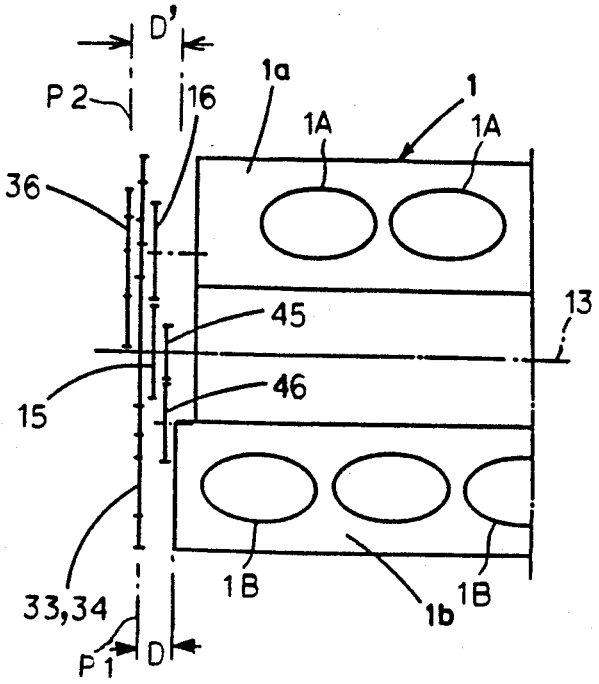
FIG. 4 is a diagrammatical view of the apparatus for driving supplementary devices of a V-type internal combustion engine equipped with various supplementary devices shown in FIG. 3.

Referring to FIGS. 3 and 4, an apparatus for driving supplementary devices in accordance with another preferred embodiment of the present invention, which is applied to a V-type overhead camshaft engine 10, is shown. This embodiment includes two cylinder banks 1*a* and 1*b*, the cylinder bank 1*b* being offset forward, with respect to a vehicle body, relative to the cylinder bank 1*a*.

The engine 10 has intake and exhaust camshafts 9 and 10, having pulleys 26 and 27, respectively, which are disposed over the cylinder bank 1*a*, and intake and exhaust camshafts 11 and 12, having pulleys 28 and 29, respectively, which are disposed over the cylinder bank 1*b*. The engine 10 further has a crankshaft 13, provided with large and small counter gears 15 and 45, and a balancer shaft 14, provided with a counter gear 16 and a double grooved pulley 32. The balancer shaft 14 is disposed parallel to and on one side of the crankshaft 13 and is rotatably connected to the crankshaft 13 by the counter gears 15 and 16 in mesh with each other. The engine 10 is provided with a supercharger 2, having a pulley 20, located in the V-shaped space 19, a water pump (not shown), having a pulley 21, disposed adjacent to the front end of the cylinder bank 1*b*, and an oil pump 4, having a pulley 22 integrally formed with a counter gear 46, disposed on the other side of the crankshaft 13. The pulleys 26–29 of the camshafts 9–12, the pulleys 21 of the water pump, and the pulley 22 of the oil pump 4 are all placed in one and the same upper half area of a plane P1, perpendicular to the crankshaft 13, located at a distance D from the front surface of the engine 10. The pulley 20 of the supercharger 2 and one groove of the pulley 32 of the balancer shaft 14 are placed in another plane P2, parallel to the plane P1 and at a distance D', larger than the distance D, from the front surface of the engine 10. The other groove of the pulley 32 is placed in the spatial plane P1. The engine 10 is further provided with various supplementary devices, such as an air compressor 5 for an air conditioning system (not shown), an alternator 6, and a power steering unit 7. The air compressor 5, having a pulley 23, is disposed on one side of the engine 10 below the cylinder head portion of the cylinder bank lb. The alternator 6, having a pulley 24, is disposed on another side of the engine 10 just below the cylinder head portion of the cylinder bank 1*b*. The power steering unit 7, having a pulley 25, is disposed on the same side as the alternator 6, remote from the side where the air compressor 5 is disposed, but below the alternator 6. Each of the pulleys 23–25 of the supplementary devices 4–7 is placed in the spatial plane P1.

The large counter gear 15 and a small counter gear 45 of the crankshaft 13 mesh with the counter gear 16 of the balancer shaft 14 and the counter gear 46 provided for the pulley 2 of the oil pump 4, respectively.

The camshafts 9–12, the water pump and the oil pump 4 are driven by a camshaft drive mechanism including a timing belt 33. That is, the pulley 22 of the oil pump 4, which is integral with the counter gear 46 in mesh with the counter gear 45, is rotatably connected to the pulleys 26–29 of the respective camshafts 26–29 and the pulleys 21 of the water pump. Each of these pulleys is placed in the spatial plane P1 at a distance D from the front surface of the engine 10 and is rotatably connected to the other pulleys by the timing belt 33 so that the camshafts 9–12 and the water pump can be driven. To apply a proper tension to the timing belt 33, tension rollers 17 are disposed at appropriate locations. The supplementary devices 5–7 are driven by a supplementary device drive mechanism including a drive belt 34. More specifically, the pulley 32 of the balancer shaft 14 is rotatably connected to the pulleys 23–25 of the air compressor 5, the alternator 6 and the power steering unit 7, respectively, each of which is placed in the lower half area of a spatial plane P1 at a distance D from the front end of the engine 10. The pulleys are rotatably connected in this way by the timing belt 34 so as to drive the air compressor 5, the alternator 6 and the power steering unit 7. To apply a proper tension to the drive belt 34, a tension roller 37 is disposed between the pulley 32 of the balancer shaft 14 and the pulley 24 of the alternator 6.

To drive the supercharger 2, the pulley 32 of the balancer shaft 14 is connected to the pulley 20 of the supercharger 2. Both of these pulleys are placed in a spatial plane P2 at a distance D', larger than a distance D, from the front end of the engine 10, and are rotatably connected to each other by a drive belt 36 through a tension roller 35.

In this embodiment, all the supplementary devices, such as the air compressor 5, the alternator 6 and the power steering unit 7, as well as the supercharger 2, are connected to the balancer shaft 14 by the drive belts 34 and 36, which are free from vibrations of the crankshaft 13. Therefore, the supplementary devices are driven by drive belts 34 and 36 which have stably maintained tensions.

In the apparatus for driving supplementary devices of a V-type internal combustion engine described above, the supercharger 2 may be driven by the crankshaft 13 instead of by the balancer shaft 14.

It is to be understood that although the present invention has been described in detail with respect to a preferred embodiment thereof, various other embodiments and variants may occur to those skilled in the art. Any such embodiments which fall within the scope and spirit of the invention are intended to be covered by the following claims.

What is claimed is:

1. An apparatus for driving supplementary devices operated by a V-type internal combustion engine including two cylinder banks disposed at an angle relative to each other, a crankshaft extending from one end of an engine block, and overhead camshafts disposed over a cylinder head of each cylinder bank, said supplementary devices being disposed below said cylinder banks, said apparatus comprising:

camshaft drive means, including a timing belt, for connecting said camshafts to said crankshaft so as to drive said camshafts;

supplementary device drive means, including a drive belt, for rotatably connecting said supplementary devices to said crankshaft so as to drive said supplementary devices; and transmission means for transmitting rotation of said crankshaft to said camshaft drive means and said supplementary device drive means, wherein said timing belt and said drive belt are both placed in a single plane perpendicular to said crankshaft.

2. An apparatus as defined in claim 1, wherein said camshaft drive means further comprises a camshaft pulley attached to each camshaft, and said timing belt rotatably connects all of the camshaft pulleys together.

3. An apparatus as defined in claim 2, wherein said supplementary device drive means further comprises a supplementary device pulley attached to each supplementary device, and said drive belt rotatably connects all of the supplementary device pulleys together.

4. An apparatus as defined in claim 1, wherein said transmission means comprises a first drive pulley rotatably connected to said camshaft pulleys by said timing belt, said first drive pulley being driven by said crankshaft.

5. An apparatus as defined in claim 4, wherein said transmission means further comprises a balancer shaft, incorporated in said engine, to which said first drive pulley is connected, said balancer shaft being rotatably connected to said crankshaft by a first gear train.

6. An apparatus as defined in claim 5, wherein said balancer shaft is disposed above said crankshaft.

7. An apparatus as defined in claim 6, wherein said transmission means comprises a second drive pulley rotatably connected to said supplementary device drive pulleys by said drive belt, said second pulley being integrally formed with said crankshaft.

8. An apparatus as defined in claim 7, and further comprising tension rollers disposed on opposite sides of said balancer shaft.

9. An apparatus as defined in claim 8, wherein said camshaft drive means comprises a water pump pulley for each of said cylinder banks.

10. An apparatus as defined in claim 4, wherein said transmission means comprises a second drive pulley rotatably connected to said supplementary device pulleys by said drive belt, said second drive pulley being rotatably connected to said crankshaft.

11. An apparatus as defined in claim 10, wherein said transmission means further comprises a balancer shaft, incorporated in said engine, to which said second drive pulley is connected, said balancer shaft being rotatably connected to said crankshaft by a first gear train.

12. An apparatus as defined in claim 11, wherein said balancer shaft is disposed beside said crankshaft.

13. An apparatus as defined in claim 12, wherein said camshaft drive means further comprises an oil pump pulley disposed on one side of one of said camshafts and opposite to a side on which said balancer shaft is disposed.

14. An apparatus as defined in claim 13, wherein said balancer shaft is rotatably connected to a supercharger disposed between said cylinder banks.

* * * * *